US007363779B2

(12) United States Patent
Kim et al.

(10) Patent No.: US 7,363,779 B2
(45) Date of Patent: Apr. 29, 2008

(54) DRUM TYPE WASHING MACHINE

(75) Inventors: Jae Kyum Kim, Gimhae-si (KR); Geon Kim, Jinhae-si (KR); Chi Wan Hur, Changwon-si (KR); Yu Beom Kang, Changwon-si (KR); Sang Man Je, Koje-si (KR)

(73) Assignee: LG Electronics Inc., Seoul (KR)

( * ) Notice: Subject to any disclaimer, the term of this patent is extended or adjusted under 35 U.S.C. 154(b) by 575 days.

(21) Appl. No.: 10/920,291

(22) Filed: Aug. 18, 2004

(65) Prior Publication Data

US 2005/0178163 A1 Aug. 18, 2005

(30) Foreign Application Priority Data

Feb. 13, 2004 (KR) ..... 10-2004-0009701

(51) Int. Cl.
*D06F 37/18* (2006.01)

(52) U.S. Cl. ..... 68/3 R; 68/212

(58) Field of Classification Search ..... 68/3 R, 68/212

See application file for complete search history.

(56) References Cited

U.S. PATENT DOCUMENTS

| | | | | |
|---|---|---|---|---|
| 5,536,540 | A * | 7/1996 | Borys et al. | 428/31 |
| 6,216,498 | B1 * | 4/2001 | Wright et al. | 68/3 R |
| 2003/0057342 | A1 * | 3/2003 | Johanson et al. | 248/346.02 |

* cited by examiner

*Primary Examiner*—Michael Cleveland
*Assistant Examiner*—Samuel A Waldbaum
(74) *Attorney, Agent, or Firm*—McKenna Long & Aldridge LLP

(57) ABSTRACT

A drum-type washing machine, by which an enhanced assembly of a top plate can be provided, is disclosed. The top plate for a washing machine includes a board covering a top of the washing machine, a front frame provided to a front side edge of the board to enhance a structural strength of the board, a rear frame provided to a rear side edge of the board to enhance the structural strength of the board, at least one connecting member provided to adjoining portions of the front and rear frames to secure the adjoining portions together, and at least one fixing guide spaced apart from the at least one connecting member, the at least one fixing guide providing a slip-fit connection between the front and rear frames.

18 Claims, 6 Drawing Sheets

DRUM TYPE WASHING MACHINE

This application claims the benefit of Korean Application No. P2004-009701, filed on Feb. 13, 2004, which is hereby incorporated by reference.

BACKGROUND OF THE INVENTION

1. Field of the Invention

The present invention relates to a drum-type washing machine, by which an enhanced assembly of a top plate can be provided.

2. Discussion of the Related Art

Generally, a drum-type washing system performs washing within a drum rotated by a drive force of a motor using friction between water and laundry. In performing washing by the drum-type washing system, the laundry is hardly damaged and is not entangled with each other. And, the drum-type washing system provides such a washing effect as beating, rubbing, and the like.

FIG. 1 is a cross-sectional diagram of a washing machine according to a related art. Referring to FIG. 1, an outer case 1 of a drum-type washing machine consists of a cabinet 2, a cabinet cover 14, and a top plate 18. The cabinet 2 covers rear and both lateral sides of the washing machine, and the cabinet cover 14 is provided to its front side. An opening is formed at a central part of the cabinet 2 so that a laundry is put/pulled in/from the washing machine via the opening. And, a door 16 is installed at a rim of the opening to open/close the opening.

A control panel 22 is provided over the cabinet cover 14, and various circuit elements controlling an operation of the washing machine are loaded on the control panel 22. A topside of the drum-type washing machine is covered with the top plate 18, and a base 20 is provided to a bottom side of the cabinet 2.

A tub (not shown) storing water therein is provided within the outer case 1, and a drum is rotatably provided within the tub. A plurality of lifters 8 is provided on an inner circumference of the drum 6 to lift a laundry up to a predetermined height to fall. Specifically, a plurality of the lifters 8 is provided on the inner circumference of the drum 6 in a circumferential direction to leave a predetermined distance from each other. Moreover, a motor is provided in rear of the tub to transfer a rotational force to the drum 6.

Meanwhile, an object may be put on a topside of the top plate of the related art drum-type washing machine. However, the weight of the object works on the topside of the top plate so that the top plate can be bent or distorted. Moreover, a bending force applied to the top plate in moving or carrying the washing machine to another place may cause damage to the top plate.

SUMMARY OF THE INVENTION

Accordingly, the present invention is directed to a drum-type washing machine that substantially obviates one or more of the problems due to limitations and disadvantages of the related art.

An object of the present invention, which has been devised to solve the foregoing problem, lies in providing a drum-type washing machine, by which an enhanced assembly of a top plate can be provided.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a top plate for a washing machine includes a board covering a top of the washing machine, a front frame provided to a front side edge of the board to enhance a structural strength of the board, a rear frame provided to a rear side edge of the board to enhance the structural strength of the board, at least one connecting member provided to adjoining portions of the front and rear frames to secure the adjoining portions together, and at least one fixing guide spaced apart from the at least one connecting member, the at least one fixing guide providing a slip-fit connection between the front and rear frames.

The fixing guide may include a first guide extending from one of the front and rear frames and having a coupling part protruding from a tip of the first guide, a recess provided to the other one of the front and rear frames to have the first guide inserted therein, and a second guide provided to a side of the recess to guide an insertion of the first guide, the second guide having a protruding part which securely engages with the coupling part of the first guide.

A tilted portion may be provided to a surface of the coupling part confronting the second guide, the tilted portion being tilted in a direction of the insertion of the first guide. And, a tilted guide surface may be provided to the protruding part of the second guide to have the tilted portion of the coupling part slid thereon. Herein, the first guide may be formed of an elastic member.

The first guide and the one of the front and rear frames may be formed as a first single body, and the second guide and the other one of the front and rear frames may be formed as a second single body. A width of the first guide may decrease toward the tip of the first guide.

An insertion part may be provided to an inside edge of each of the front and rear frames to have the board inserted therein. And, the connecting member and the fixing guide may be provided to both side edges of the adjoining portions of the front and rear frames, respectively.

In another aspect of the present invention, a drum-type washing machine includes a cabinet forming an exterior of the drum-type washing machine, a tub provided within the cabinet, a drum rotatably provided within the tub, and a top plate covering a top of the cabinet, wherein the top plate includes a board, a front frame provided to a front side edge of the board to enhance a structural strength of the board, a rear frame provided to a rear side edge of the board to enhance the structural strength of the board, at least one connecting member provided to adjoining portions of the front and rear frames to secure the adjoining portions together, and at least one fixing guide spaced apart from the at least one connecting member, the at least one fixing guide providing a slip-fit connection between the front and rear frames.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

Figure 1:
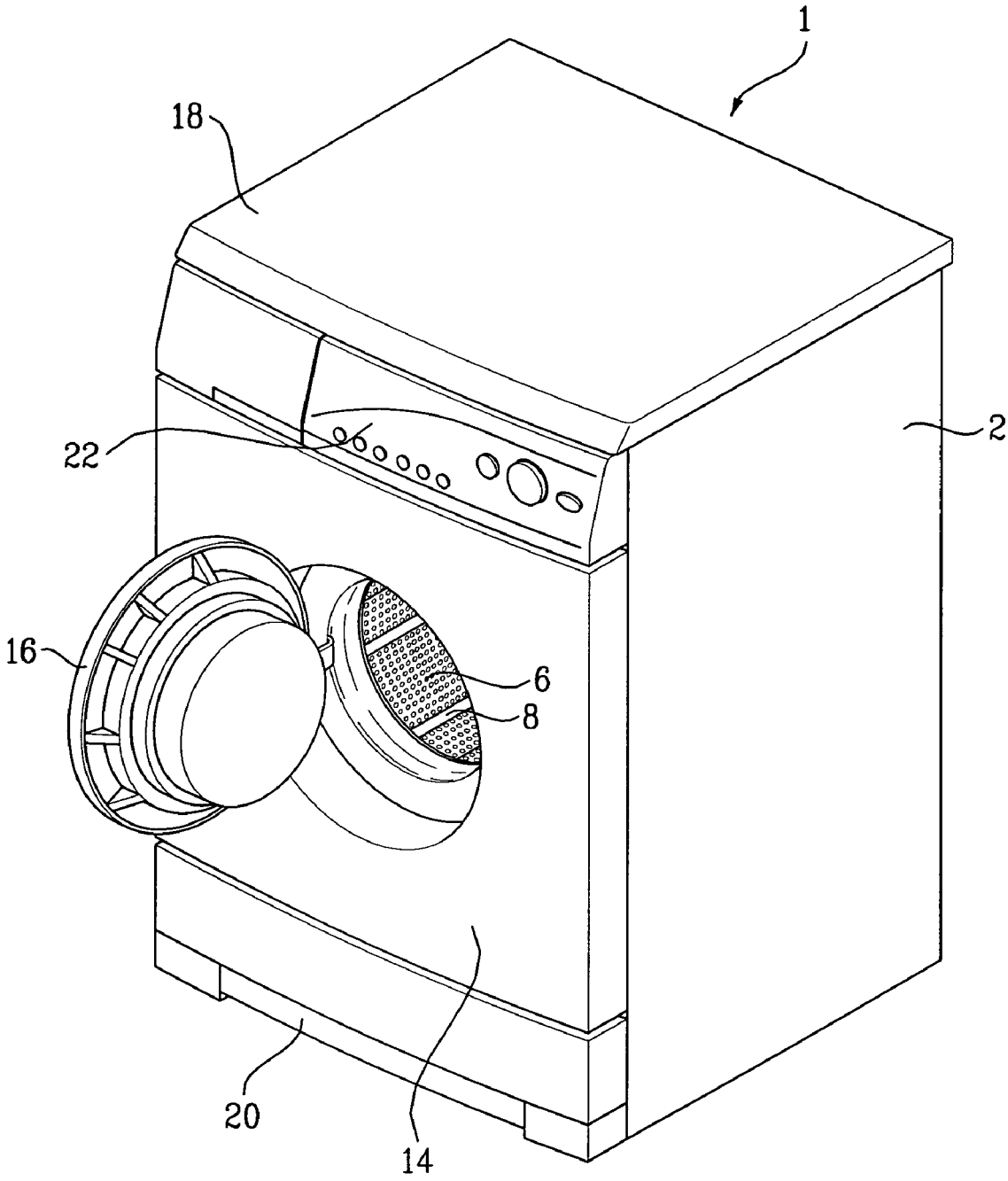
FIG. 1 is a perspective diagram of a general drum-type washing machine.
Figure 2:
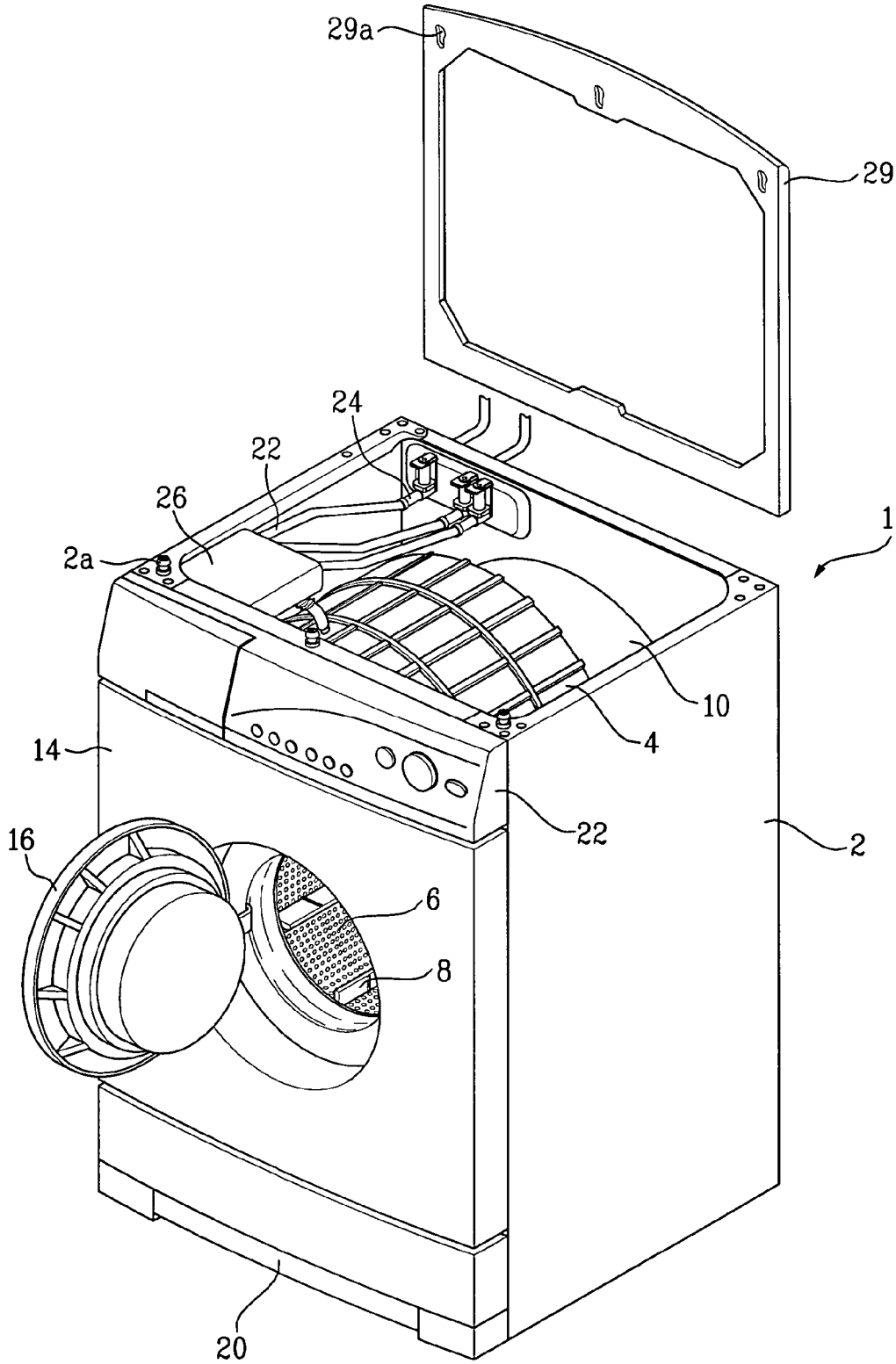
FIG. 2 is a perspective diagram of a drum-type washing machine according to the present invention.

First of all, a drum-type washing machine according to the present invention is explained in detail by referring to FIGS. 2 to 6 as follows. FIG. 2 is a perspective diagram of a drum-type washing machine according to the present invention. Referring to FIG. 2, an outer case 1 of a drum-type washing machine according to the present invention includes a cabinet 2, a cabinet cover 14, and a top plate 29. The cabinet cover 14 is provided to a front side of the cabinet 2, and an opening is formed in a central part of the cabinet cover 14. And, a door 16 is provided to a rim of the opening to open/close the opening.

A tub 4 is provided within the outer case 1, and a drum 6 is rotatably provided within the tub 4. At least one lifter 8 is provided on an inner circumference of the drum 6 to lift a laundry to fall by gravity. And, a bearing housing 10 is provided in rear of the tub 4. Moreover, a motor is loaded in the bearing housing 10 to rotate the drum 6. Meanwhile, a plurality of holes 29*a* is formed at a bottom side of the top plate 29, and a plurality of holders 2*a* is provided to an upper end of the cabinet 2. By inserting the holders 2*a* to the corresponding holes 29*a*, respectively, the top plate 29 is fixed to a topside of the cabinet 2.

A control panel 22 controlling an operation of the washing machine is provided over the cabinet cover 14. An inlet hose 22, inlet valve 24, and detergent box 26 for supplying water or detergent to the tub 4 are provided in rear of the control panel 22. A base 20 is provided to a bottom side of the washing machine. And, a drain pump (not shown) and drain hose (not shown) are provided on the base 20 to discharge the water. Meanwhile, a topside of the washing machine is covered with the top plate 29.

Figure 3:
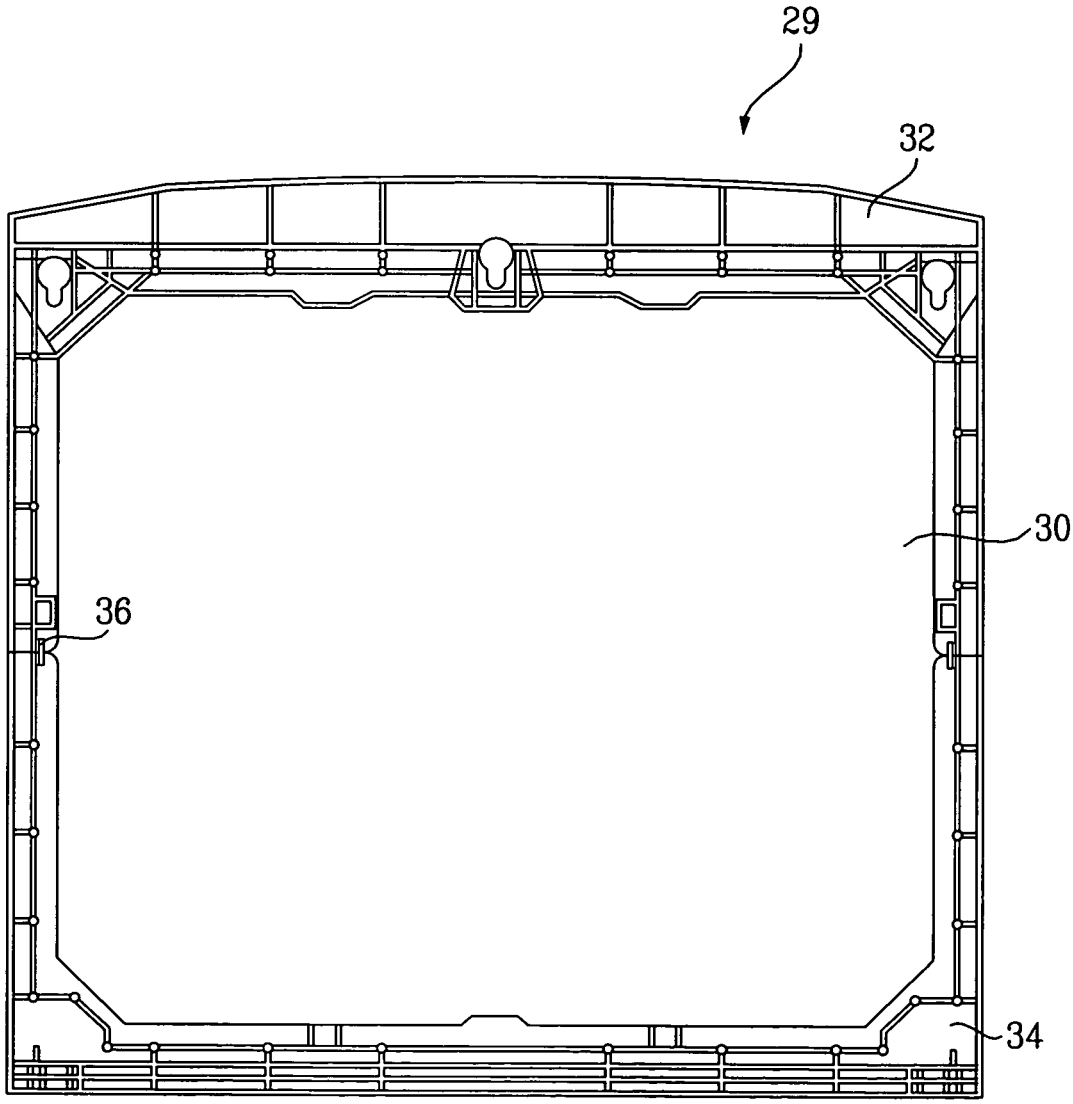
FIG. 3 is a layout of a bottom side of a top plate of a drum-type washing machine according to one embodiment of the present invention.

FIG. 3 is a layout of a bottom side of a top plate of a drum-type washing machine according to one embodiment of the present invention. Referring to FIG. 3, the top plate 29 includes a top plate board 30, a front frame 32, and a rear frame 34. The front frame 32 is provided to a front side edge of the top plate board 30, and the rear frame 34 is provided to a rear side edge of the top plate board 30. In order to reinforce rigidity (or enhance the structural strength) of the top plate board 30, the front and rear frames 32 and 34 protrude in a bottom direction of the top plate board 30. In this case, the front and rear frames 32 and 34 are formed of a synthetic resin based material by injection molding.

Meanwhile, both ends of the front frame 32 are connected to both ends of the rear frame 34 by a pair of connecting members 36, respectively. Preferably, the connecting member 36 is a staple. Namely, both of the confronting ends of the front and rear frames 32 and 34 are connected to each other by a pair of the connecting members 36, respectively. Thus, the front and rear frames 32 and 34 are fixed to each other by the connecting members 36 and are then loaded on the bottom side of the top plate board 30. Thereafter, the top plate 29 is loaded on a topside of the washing machine.

Figure 4:
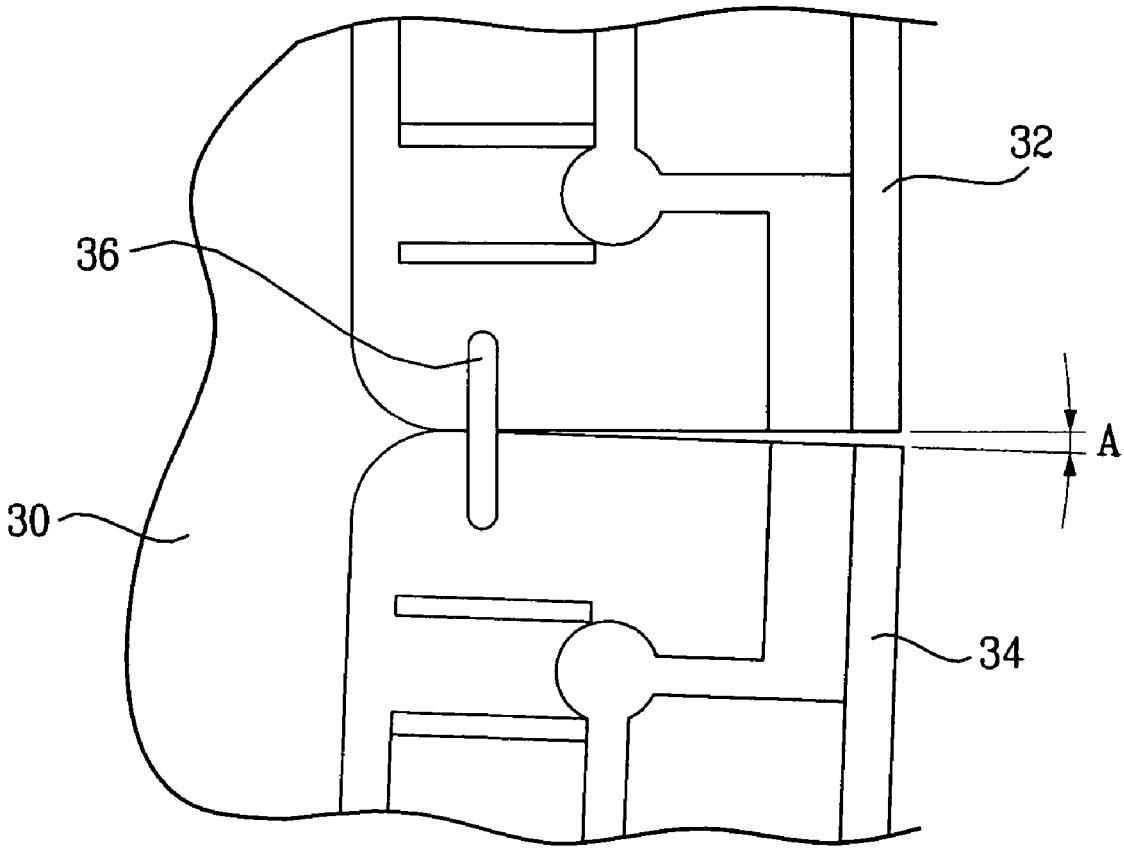
FIG. 4 is a magnified diagram of a top plat according to one embodiment of the present invention.

FIG. 4 is a magnified diagram of a top plate according to one embodiment of the present invention. Referring to FIG. 4, the front and rear frames 32 and 34 are connected by the connecting member 36. Each of the front and rear frames 32 and 34 contracts or expands according to a temperature of a cold-resistant or heat-resistant test. Each of the front and rear frames 32 and 34 has a predetermined width in right-to-left direction, whereas the connecting member 36 is one-sided to connect the front and rear frames 32 and 34. Hence, the front and rear frames 32 and 34 asymmetrically contract or expand in the connected portions, respectively, whereby a gap takes place between the connected portions of the front and rear frames 32 and 34.

The connected portions of the first and second frames 32 and 34 cannot be completely fixed to each other by the connecting member 36. The farther the connected portions are left part from the connecting member 36, the wider the gap 'A' increases. In order to suppress the occurrence of the gap 'A', a loading position of the connecting member 36 can be moved to a central part. Yet, the gap 'A' still occurs due to an amount of the expansion or contraction occurring in a location outward distant from the connecting member 36. Thus, the gap 'A' ruins an exterior of the rum type washing machine 1 and fails to meet user's satisfaction. Such a problem can be solved by another embodiment of the present invention.

Figure 5:
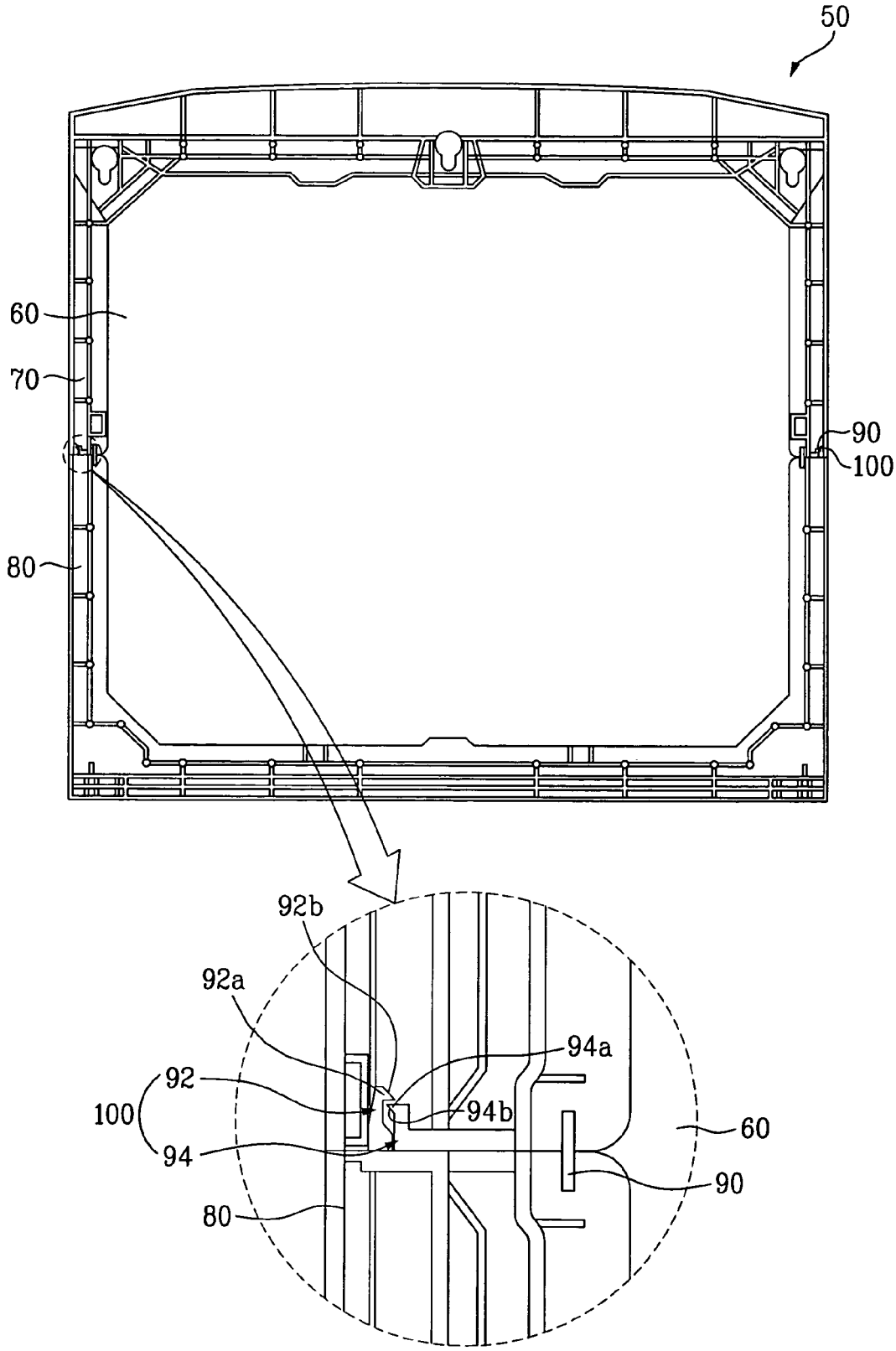
FIG. 5 is a layout of a bottom side of a top plate of a drum-type washing machine according to another embodiment of the present invention.

FIG. 5 is a diagram of a bottom side of a top plate of a drum-type washing machine according to another embodiment of the present invention. Referring to FIG. 5, the top plate 50 covers a topside of the drum-type washing machine 1. And, the top plate 50 includes a top plate board 60, a front frame 70, and a rear frame 80. Each of the front and rear frames 70 and 80 has a channel shape to enclose edges of the top plate board 60. Namely, the front frame 70 is provided to a front side edge of the top plate board 60 and the rear frame 80 is provided to a rear side edge of the top plate board 60. In this case, the front and rear frames 70 and 80 are formed of a synthetic resin based material by injection molding.

Meanwhile, both ends of the front frame 70 are connected to both ends of the rear frame 80 by a pair of connecting members 90, respectively. Namely, both of the confronting ends of the front and rear frames 70 and 80 are connected to each other by a pair of the connecting members 90, respectively. Simultaneously, a pair of the connecting members 90 fixes the frames 70 and 80 to the top plate board 60 as well. Preferably, the connecting member 90 is a staple.

Referring to the magnified diagram in FIG. 5, a fixing guide 100 is provided to a location leaving a predetermined distance from the corresponding connecting member 90 to fix the corresponding ends of the frames 70 and 80 to each other and to guide a corresponding assembly.

Figure 6:
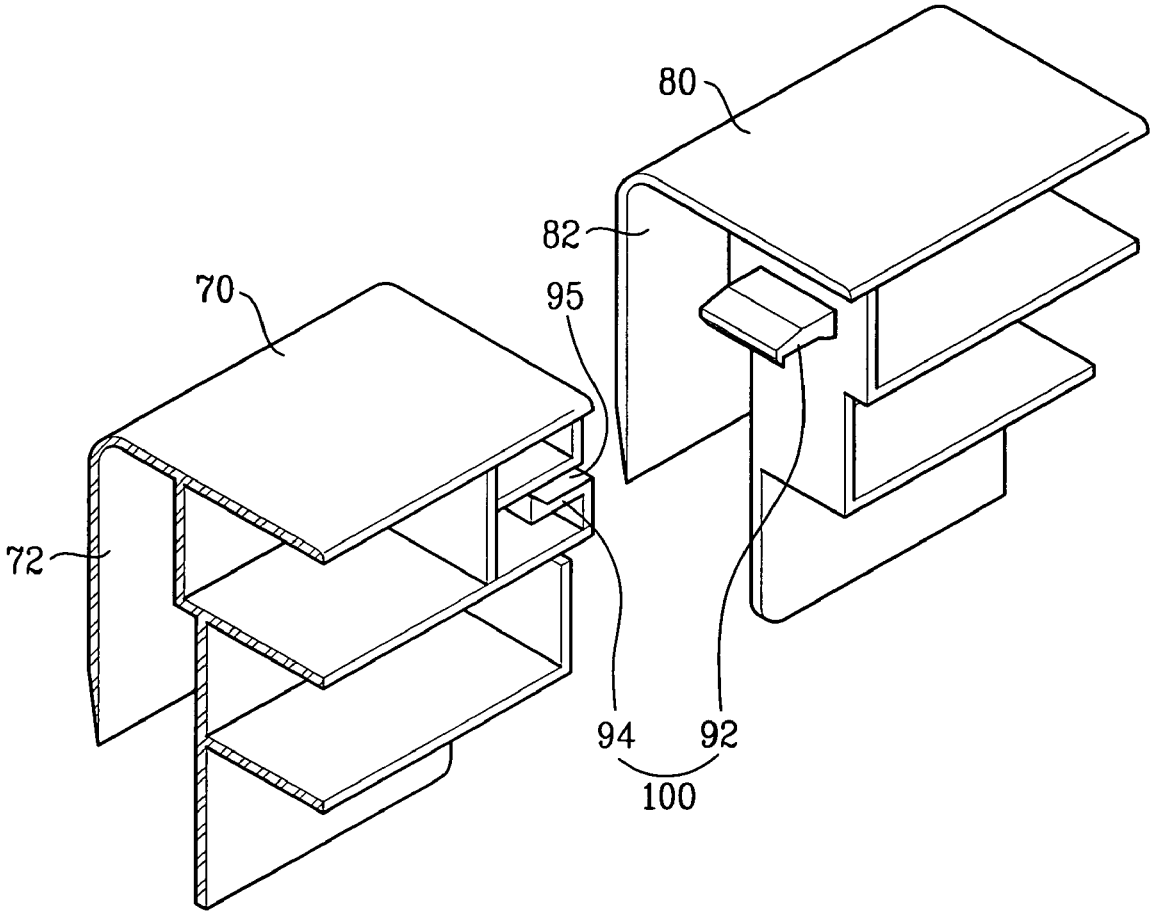
FIG. 6 is a perspective diagram of a top plate according to another embodiment of the present invention.

FIG. 6 is a perspective diagram of a top plate according to another embodiment of the present invention. Referring to FIGS. 5 and 6, insertion parts 72 and 82 are provided to inside edges of the front and rear frames 70 and 80 to have the top plate board 60 inserted therein. While the top plate board 60 is inserted in the insertion parts 72 and 78, the connecting member 90 is installed. In doing so, the front frame 70, rear frame 80, and top plate board 60 are simultaneously fixed to each other by the connecting member 90.

The fixing guide includes a first guide 92 and a second guide 94. The first guide 92 protrudes from one of the frames 70 and 80, and the second guide 94 provided to the other frame is coupled to the first guide 92. In doing so, the first guide 92 is inserted in a recess 95 formed on a lateral side of the second guide 94 and is then held by the second guide 94 to be fixed thereto.

In this case, a tilted part 92*b* and a coupling part 92*a* are provided to the first guide 92. The coupling part 92*a* protrudes from a tip of the first guide 92 in a direction confronting the second guide 94. The tilted part 92*b* is formed at a portion of the coupling part 92*a* confronting the second guide 94 to be tilted in an inserting direction. The coupling part 92*a* is inserted in the recess 95 along the second guide 94 and is then held by a protruding part 94*a* formed at the second guide 94 to be fixed thereto.

Namely, the second guide 94 is formed to confront the first guide 92. And, the protruding part 94*a* is formed at a tip of the second guide 94 to hold the coupling part 92*a* of the first guide 92. In this case, the first guide 92 has a shape decreasing in width toward its tip to be easily inserted in the recess 95.

A guide surface 94*b*, as shown in FIG. 5, is formed at the protruding part 94*a* to be contacted with the tilted part 92*b* of the first guide 92. When the first guide 92 is inserted in the recess 95, the tilted part 92*b* slides along the guide surface 94*b*. After the coupling part 92*a* has been moved over the protruding part 94*a*, the coupling part 92*a* is held by the protruding part 94*a* to be fixed thereto. In doing so, the elastic transformation of the first guide 92 enables the coupling part 92*a* passes through the protruding part 94*a*. Once the first guide 92 is restored from the elastic transformation, the coupling part 92*a* is finally held by the protruding part 94*a*. Preferably, the first guide 92 is built in one body of one of the front and rear frames 70 and 80 and the second guide 94 is built in one body of the rest frame.

An assembly process of the top plate of the drum-type washing machine according to the present invention is explained in detail as follows.

First of all, a front side rim of the top plate board 60 is inserted in the insertion part 72 of the front frame 70 and a rear side rim of the top plate board 60 is inserted in the insertion part 82 of the rear frame 80. In doing so, the first guide 92 provided to one frame 70 or 80 is inserted in the recess 95 formed at the other frame 80 or 70. And, the front and rear frames 70 are guided by the first and second guides 92 and 94 to be loaded on the correct positions, respectively.

Meanwhile, once the first guide 92 is fully inserted in the recess 95 formed in the vicinity of the second guide 94, the coupling part 92*a* of the second guide 92 is held by the protruding part 94*a* provided to the second guide 94 to be fixed thereto. In this case, both ends of the front frame 70 coupled to the top plate board 60 are contacted with both ends of the rear frame 80 coupled to the top plate board 60, respectively. The connecting members 90 are provided to both of the contacted ends of the front and rear frames 70 and 80 to fix to each other, respectively. Each of the connecting members is coupled to the top plate board 60 as well as connects the corresponding contacted ends of the front and rear frames 70 and 80. Hence, the front and rear frames 70 and 80 are concretely fixed to the edges or rim of the top plate board 60 by the connecting members 90 and the fixing guides 100.

Besides, in order to fix the frames 70 and 80 to the edges of the top plate board 60 more stably, a plurality of auxiliary connecting members can be coupled to the frames 70 and 80 except their contacted ends. Thus, both of the contacted ends of the front and rear frames 70 and 80 are stably fixed to each other by the connecting members 90 and the fixing guides 100, respectively. Even if the front and rear frames 70 and 80 contract or extract according to a temperature change during a cold-resistant or heat-resistant test, the gap is prevented from occurring between the connected portions of the frames 70 and 80.

Preferably, the connecting member 90 leaves a maximum distance from the fixing guide 100 in a right-to-left direction of the connected portions of the front and rear frames 70 and 80. Hence, the connecting member 90 fixes one side of the connected portions and the fixing guide 100 fixes the other side of the connected portions, whereby the gap occurrence can be highly prevented.

Accordingly, the present invention has the following advantages or effects.

First of all, the frames for rigidity reinforcement of the edges of the top plate are provided to prevent the top plate from being broken or distorted by an external force. Secondly, the connected or contacted portions of the frames are coupled to each other by the corresponding connecting member and fixing guide, whereby the gap is prevented from occurring between the connected portions of the frames due to the transformation caused by the cold-resistant or heat-resistant test. Therefore, it is able to meet the consumer's satisfaction for the product. Finally, the frames are guided by the fixing guide to be coupled to each other, whereby the corresponding assembly is facilitated.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A top plate for a washing machine, comprising:

a board covering a top of the washing machine;

a front frame provided to a front side edge of the board to enhance a structural strength of the board;

a rear frame provided to a rear side edge of the board to enhance the structural strength of the board;

at least one connecting member provided to adjoining portions of the front and rear frames to secure the adjoining portions together;

at least one fixing guide spaced apart from the at least one connecting member, the at least one fixing guide providing a slip-fit connection between the front and rear frames; and an insertion part provided to an inside edge of each of the front and rear frames to have the board inserted therein.

2. The top plate of claim 1, wherein the fixing guide comprises:

a first guide extending from one of the front and rear frames and having a coupling part protruding from a tip of the first guide;

a recess provided to the other one of the front and rear frames to have the first guide inserted therein; and a second guide provided to a side of the recess to guide an insertion of the first guide, the second guide having a protruding part which securely engages with the coupling part of the first guide.

3. The top plate of claim 2, wherein a tilted portion is provided to a surface of the coupling part confronting the second guide, the tilted portion being tilted in a direction of the insertion of the first guide.

4. The top plate of claim 3, wherein a tilted guide surface is provided to the protruding part of the second guide to have the tilted portion of the coupling part slid thereon.

5. The top plate of claim 2, wherein the first guide is formed of an elastic member.

6. The top plate of claim 2, wherein the first guide and the one of the front and rear frames are formed as a first single body, and the second guide and the other one of the front and rear frames are formed as a second single body.

7. The top plate of claim 2, wherein a width of the first guide decreases toward the tip of the first guide.

8. The top plate of claim 1, wherein the connecting member and the fixing guide are provided to both side edges of the adjoining portions of the front and rear frames, respectively.

9. The top plate of claim 1, wherein the connecting member comprises a staple.

10. A drum-type washing machine, comprising:

a cabinet forming an exterior of the drum-type washing machine;

a tub provided within the cabinet;

a drum rotatably provided within the tub; and a top plate covering a top of the cabinet, wherein the top plate comprises:

a board;

a front frame provided to a front side edge of the board to enhance a structural strength of the board;

a rear frame provided to a rear side edge of the board to enhance the structural strength of the board;

at least one connecting member provided to adjoining portions of the front and rear frames to secure the adjoining portions together;

at least one fixing guide spaced apart from the at least one connecting member, the at least one fixing guide providing a slip-fit connection between the front and rear frames; and an insertion part provided to an inside edge of each of the front and rear frames to have the board inserted therein.

11. The drum-type washing machine of claim 10, the fixing guide comprising:

a first guide extending from one of the front and rear frames and having a coupling part protruding from a tip of the first guide;

a recess provided to the other one of the front and rear frames to have the first guide inserted therein; and a second guide provided to a side of the recess to guide an insertion of the first guide, the second guide having a protruding part which securely engages with the coupling part of the first guide.

12. The drum-type washing machine of claim 11, wherein a tilted portion is provided to a surface of the coupling part confronting the second guide, the tilted portion being tilted in a direction of the insertion of the first guide.

13. The drum-type washing machine of claim 12, wherein a tilted guide surface is provided to the protruding part of the second guide to have the tilted portion of the coupling part slid thereon.

14. The drum-type washing machine of claim 11, wherein the first guide is formed of an elastic member.

15. The drum-type washing machine of claim 11, wherein the first guide and the one of the front and rear frames are formed as a first single body, and the second guide and the other one of the front and rear frames are formed as a second single body.

16. The drum-type washing machine of claim 11, wherein a width of the first guide decreases toward the tip of the first guide.

17. The drum-type washing machine of claim 10, wherein the connecting member and the fixing guide are provided to both side edges of the adjoining portions of the front and rear frames, respectively.

18. The drum-type washing machine of claim 10, wherein the connecting member comprises a staple.

* * * * *